United States Patent [19]

Peeters et al.

[11] 4,223,084

[45] Sep. 16, 1980

[54] PHOTOCONDUCTIVE ELEMENT BASED ON MIXED ZINC OXIDES

[75] Inventors: Wilhelmus M. M. Peeters, Neer; Wilhelmus J. van Rhijn, Venlo; Robert M. G. Timmermans, Venlo-W., all of Netherlands

[73] Assignee: Océ-van der Grinten N.V., Venlo, Netherlands

[21] Appl. No.: 805,308

[22] Filed: Jun. 10, 1977

[30] Foreign Application Priority Data

Jun. 28, 1976 [NL] Netherlands ..... 7607044

[51] Int. Cl.[2] ..... G03G 5/087

[52] U.S. Cl. ..... 430/87; 430/96; 430/64; 430/126

[58] Field of Search ..... 96/1.8, 1.7

[56] References Cited

U.S. PATENT DOCUMENTS 3,929,480 12/1975 Perlis ..... 96/1.8

FOREIGN PATENT DOCUMENTS 1334770 10/1971 United Kingdom ..... 96/1.8

*Primary Examiner*—Roland E. Martin, Jr.
*Assistant Examiner*—John L. Goodrow
*Attorney, Agent, or Firm*—Albert C. Johnston; Alphonse R. Noë

[57] ABSTRACT

A photoconductive element giving prolonged service without appreciable deterioration of its properties as the imaging medium in an indirect electrophotograpic copier is obtained by the provision, on an electrically conductive support that preferably is electrically conductive paper coated with a thin layer of hydroxyethyl cellulose, of a photoconductive layer composed essentially of continuous tone zinc oxide and at least one other photoconductive zinc oxide dispersed in a binder consisting predominantly of an organic polymer having an acid number between 10 and 30, such as an acrylic resin or such resin with 1 to 15% of styrene-modified alkyd resin, at a weight ratio of between 5 and 3 parts of zinc oxide per part of binder. The content of continuous tone zinc oxide preferably is limited to a minor proportion amounting to between 6 and 30% of the total zinc oxide content.

2 Claims, No Drawings

PHOTOCONDUCTIVE ELEMENT BASED ON MIXED ZINC OXIDES

This invention relates to a photoconductive element of a type having a photoconductive layer which comprises at least two photoconductive zinc oxides dispersed in a binder.

Certian known photoconductive elements of that type are used especially is direct electrophotography, for which purpose they generally meet the practical requirements. A problem exists, however, if such photoconductive elements are to be used in indirect electrophotographic processes. For that use the photoconductive element not only must possess satisfactory values of certain electrophotographic properties, such as light-sensitivity and charging and discharging behavior, but must also retain these values over a considerable period of service, not withstanding frequent use of the photoconductive element, in order to be able to continue producing copies of good quality. Moreover, the photoconductive layer must have good resistance to the mechanical stresses of repeated use, and it may show acceptably a low memory effect at most. Although many photoconductive elements based on zinc oxide have been proposed for use in indirect electrophotography, none of them is completely satisfactory in all these respects.

The purpose of the present invention is to provide a photoconductive element which is suitable in every respect for use in an indirect electrophotographic copier, and which has a long service life during which it retains satisfactory copying properties.

According to the invention, a photoconductive element of the type first above mentioned is provided in which one of the zinc oxides is a continuous tone zinc oxide, the binder consists predominantly of an organic polymer having an acid number between 10 and 30, and the weight ratio of zinc oxide to binder lies between 5:1 and 3:1. Further, it has been found that optimal electrophotographic properties are obtained in the element and their deterioration is minimal when the content of continuous tone zinc oxide in the photoconductive layer of the element amounts to between 6 and 30% of the total zinc oxide content, by weight.

Preferably the binder comprises an acrylic resin having an acid number in the stated range, such as, for example, the products available commercially from De Soto, Inc. as its resins Nos. E048, E041 and E202, which contain styrene-ethyl acrylate copolymer, and a resin known as Synolac 608S, which is produced in England, or mixtures of such products. In order to enhance the mechanical properties and permanence of the photoconductive layer, the binder preferably comprises also, in addition to the acrylic resin, a relatively small amount of a styrene-modified alkyd resin: for which purpose quantities of between 1 and 15%, based on the total weight of dry resins, are amply sufficient.

Continuous tone zinc oxide is zinc oxide having a thin depletion layer as compared with that of the normal photoconductive zinc oxides, thus resulting in a relatively low chargeability and a soft gradation. Continuous tone zinc oxide is available commercially from several sources, for instance, as products of New Jersey Zinc Company identified by the code numbers CT 011 and CT 012, and as a product of Durham Chemicals Ltd. (England) designated CT 2378. In addition to the continuous tone zinc oxide, the photoconductive layer of the photoconductive element according to the invention also contains at least one other photoconductive zinc oxide which may be selected from among various commercially available products such, for example, as those known as Photox 80, Electrox 2500 and Neige C.

The photoconductive layer of the photoconductive element can be sensitized in the usual way with dyes such as bromophenol blue, rhodamine B, Rose Bengal and fluorescein. A commonly used quantity of such dyes of between approximately 10 and 1,000 mg per 100 grams of zinc oxide can be used without any problem.

Photoconductive elements provided according to the invention have electrophotographic and mechanical properties which remain nearly constant for a long time, notwithstanding frequently repeated use of the elements for the formation and transfer of images in electrophotographic copying machines. The longevity of such service is especially notable when the zinc oxide to binder weight ratio lies between 4.5:1 and 3.5:1. Remarkably, this constancy of behavior scarcely occurs if the zinc oxide to binder ratio lies outside the range of between 5:1 and 3:1.

It has been observed, strikingly, that the dielectric constant of the photoconductive layer changes only slightly during prolonged use of the photoconductive element in an indirect electrophotographic copier, and in consequence the charging behavior changes to a remarkably slight extent. Moreover, the dielectric constant is accurately reproducible notwithstanding the unavoidable fluctuations of processing conditions which occur in making the photoconductive layer, such as during batchwise preparation of the dispersions required. Further it has been found that the charging behavior changes minimally upon changes in the relative humidity and temperature. With such a stable photoconductive element copies can be produced with a consistently good quality which is little affected by variations in the performance properties of the charging corona and other functions of the copying apparatus, such as those which result from manufacturing tolerances.

The latter advantage is still more favorable when the the element is made with a paper support having an interlayer of hydroxyethylcellulose applied to it between the support and the photoconductive layer. An interlayer containing, for instance, as little as approximately 1.5 g of hydroxyethylcellulose per $m^2$ is quite satisfactory. The paper support can be any paper of the many commercially available paper grades used in electrophotography. Generally, it has a specific resistance of less than $10^{10}$ ohm.cm. The specific resistance can have been brought to a desired value suited for the electrophotographic use by a conductive powder, such as carbon, incorporated in the paper.

Although a paper support coated with a hydroxyethylcellulose layer is preferred, a paper base coated with a dispersion of carbon in an organic binder, such as cellulose acetate butyrate, may also be used. The support for the photoconductive layer can also be one of the metal supports known to be suitable for electrophotographic material, which may or may not be coated with a barrier layer, or one of the known plastic supports coated with an electrically conductive layer. In the use of a paper support it often is desirable to provide a coated layer on its rear side also, in order to avoid curling of the photoconductive element. Hydroxyethylcellulose can be used for that purpose, just as for the interlayer.

The photoconductive element according to the invention is useful as the imaging medium in any of the known types of indirect electrophotographic copiers which can make use of photoconductive elements based on zinc oxide. For instance, the invention is useful in the form of an endless zigzag folded belt in apparatus of the type disclosed in U.S. Pat. No. 3,926,625.

The practice of the invention will be further understood from the following Example.

A carbonaceous paper weighing 106 g per $m^2$ and having a specific resistance of $10^8$ ohm.cm was coated on both sides with a layer of hydroxyethylcellulose having a dry weight of 1.5 g per $m^2$. One side was overcoated with a dispersion of the following composition:

| | |
|---|---|
| 75 | parts by weight of Electrox 2500, a normal photoconductive zinc oxide; |
| 25 | parts by weight of CT 011, a continuous tone zinc oxide; |
| 22.5 | parts by weight of a copolymer of styrene and ethyl acrylate having an acid number of 17 (the resin E048, commercially available in the form of a 50% by weight solution in a mixture of toluene, xylene and propanol); |
| 2.5 | parts by weight of a styrene-modified alkyd resin (the resin E09, commercially available in the form of a 50% by weight solution in a mixture of toluene, xylene and ethyl benzene); |
| 0.16 | parts by weight of rhodamine B, in the form of an 8% by weight solution in methanol; |
| 0.16 | parts by weight of bromophenol blue; and |

-continued

| | |
|---|---|
| 125 | parts by weight of toluene. |

The weight of the dried photoconductive layer was 28 g per $m^2$. The resulting photoconductive element had a light-sensitivity of 6μ-Joules per $cm^2$, measured with light of a xenon flash lamp. The electrophotographic properties, including light-sensitivity, had hardly changed at all after an image area of the photoconductive element had been used for 150 times for the production of copies in an indirect electrophotographic copier.

We claim:

1. In a photoconductive element for indirect electrophotography having a photoconductive layer which comprises at least two photoconductive zinc oxides dispersed in a binder, the improvement whereby the photoconductive element is enhanced in constancy of behavior and service life for repeated use in indirect electrophotography, comprising that said zinc oxides consist essentially of between 6 and 30% by weight of continuous tone zinc oxide and between 70 and 96% by weight of photoconductive zinc oxide that is not continuous tone zinc oxide and said binder consists predominantly of an acrylic resin having an acid number between 10 and 30 and also comprises 1 and 15% by weight of styrene-modified alkyd resin, and the weight ratio of zinc oxide to binder lies between 5:1 and 3:1.

2. The improved photoconductive element according to claim 1, said photoconductive layer being carried on a support of electrically conductive paper having a thin coating of hydroxyethylcellulose thereon between the paper and the photoconductive layer.

* * * * *